United States Patent [19]

Borell

[11] 3,971,286

[45] July 27, 1976

[54] GUITAR STRING SUPPORTING DEVICE

[76] Inventor: James J. Borell, 1318 W. Oak St., Kissimmee, Fla. 32741

[22] Filed: Aug. 27, 1975

[21] Appl. No.: 608,063

[52] U.S. Cl. ..... 84/298; 84/307; 84/314

[51] Int. Cl.[2] ..... G10D 3/04

[58] Field of Search ..... 84/173, 267, 298, 299, 84/307, 312, 314

[56] References Cited

UNITED STATES PATENTS

| | | | |
|---|---|---|---|
| 294,832 | 3/1884 | Wichard | 84/298 |
| 2,524,144 | 10/1950 | Smith | 84/312 |
| 2,764,052 | 9/1956 | McBride | 84/307 |
| 2,846,915 | 8/1958 | Daria | 84/307 |
| 3,783,731 | 1/1974 | Pash | 84/173 |

*Primary Examiner*—Lawrence R. Franklin
*Attorney, Agent, or Firm*—Roger L. Martin

[57] ABSTRACT

Devices for supporting guitar strings at the bridge and nut ends of the keyboard include a body portion with an axially vertical threaded bore that houses a screw element. A slot is provided in the body so that the string rests and is supported on the upper surface of the element. The element has a surface recess adapted for reception of a tool used to raise and lower the element in the bore and to thus raise and lower the support for the string. The recess is preferably surrounded by a flat uninterrupted surface to provide a string supporting surface at all rotative positions. If movement of the support longitudinally of the string is desired, a screw member mounted on a bracket and engaging the body portion within a threaded bore below the screw element may be used.

10 Claims, 11 Drawing Figures

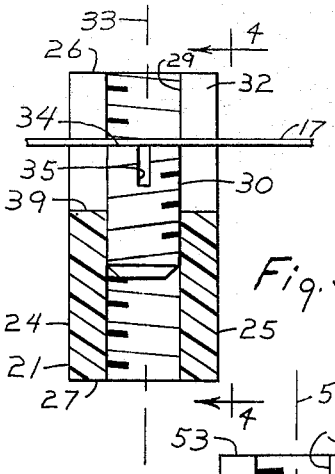
Fig. 3
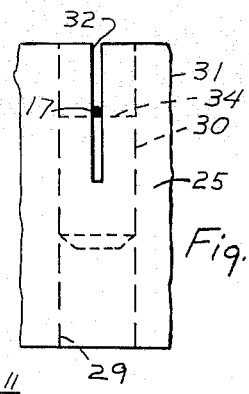
Fig. 4
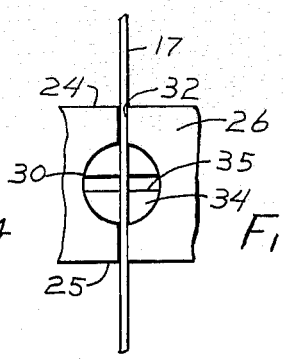
Fig. 5
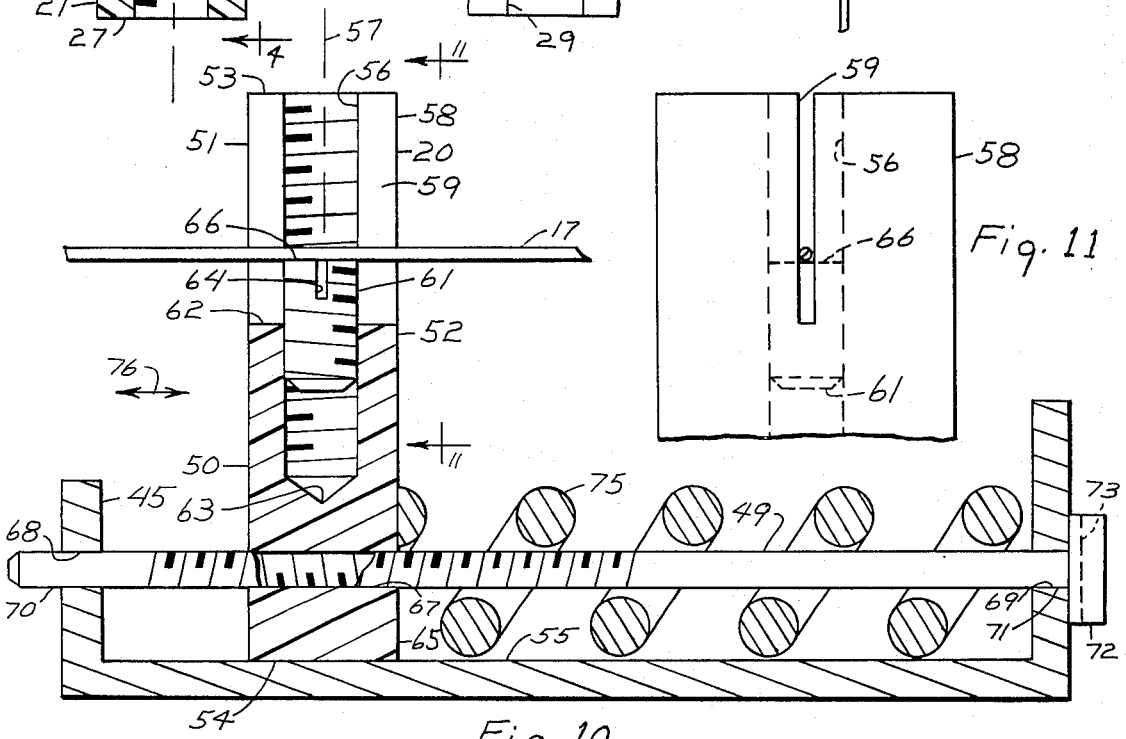
Fig. 10
Fig. 11
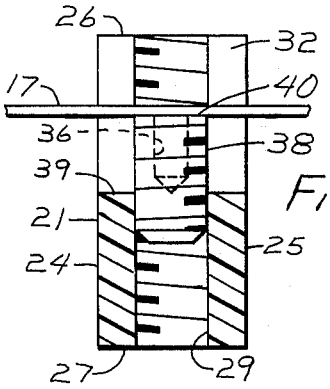
Fig. 6
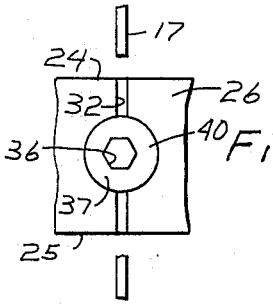
Fig. 7

GUITAR STRING SUPPORTING DEVICE

BACKGROUND OF THE INVENTION

The invention relates to a device for supporting a guitar string above the keyboard.

Mechanisms for adjusting the spaced relationship between a guitar string and the keyboard are known as are mechanisms for adjusting the string supports longitudinally of the strings so that the strings may be tuned to the keyboard of the guitar. Such mechanisms suffer from various disadvantages. In some cases, the vertical adjustment of a string at either the nut or bridge end of the keyboard can only be accomplished by a similar vertical adjustment to all of the strings on the guitar. In other cases, mechanisms have been devised to permit the vertical adjustments of each individual string but they have the disadvantage among others that the mechanisms are complicated in structure and hence expensive to manufacture. Typical prior art devices are evident in U.S. Pat. Nos. 1,335,142, 1,338,583, 1,475,345, 1,571,118, 2,959,085, 3,429,214 and 3,599,524.

The ability to vertically adjust the location of the supports for guitar strings in conventional guitars is desired primarily to facilitate easier depression of the strings into the keyboard positions. The vertically adjustable string supports that are in common use are accordingly mainly provided to facilitate development of the string touch characteristics that are most familiar or most acceptable to the player.

In recent years developments have been made which enable other instruments to be played in duet fashion by a person playing a guitar. The tone producers of the other instruments are usually keyed in such instances by an electrical switching action that is initiated by the finger manipulations of the guitar player on the guitar keyboard. Among the various methods for accomplishing the switching actions are those which involve the use of so-called "birfurcated" frets with fret segments that form components of an electrical circuit which is energized by a switching action that transpires when the string is depressed into contact with the fret segment. These methods, which may involve string contact with one or more frets in order to key in a tone producer of the other instrument, are illusted in the following U.S. patents among others: U.S. Pat. Nos. 3,465,086, 3,786,167 and 3,871,247. With such instruments, the need for the proper adjustment of the keyboard fret and string relations is most critical and current methods have generally been unacceptable.

BRIEF SUMMARY OF INVENTION

A general object of the invention is to provide an improved guitar string support which permits the guitar string to be vertically adjusted relative to the guitar keyboard. One particular object is to provide vertical adjusting means for guitar strings that are simple and inexpensive to manufacture and which enable each string to be adjusted independently and without concern for the effects of adjusting one string on the location of the other guitar strings. Yet another object is to provide improved string adjusting means for guitars that are equipped for the play of other instruments in duet fashion. One particular object is to provide a simple and inexpensive device of the kind contemplated.

In accord with the invention, the inventor provides a body portion which is mounted at one end of the keyboard and provided with a threaded bore in which a screw element is received. The upper portion of the body portion has a slot for reception of the guitar string and which lies in the plane that is common to the axis of the bore and to the string so that the string rests and is supported on the upper surface of the screw element. The upper surface of the screw element has a recess for the reception of a tool that may be inserted in the bore to rotatively manipulate the screw element and thus to raise and lower the location of the upper surface relative to the keyboard. This recess may take the form of a diametrically extending slot that is adapted to receive the wedge shaped working end of a conventional screwdriver but is preferably a center recess that is surrounded by a continuous planar portion of the upper surface since this latter type structure avoids the limiting position of adjustment where the supported string would be aligned with the slot in the screw element and hence, capable of assuming a position in the recess that is lower than that desired.

The body portions for the devices used for the respective strings may be made unitary in an assembly where movement longitudinally of the strings is unnecessary to tune the string to the keyboard. Alternatively, the body portions for each string supporting device may be separate and coupled to means for moving the body portion longitudinally of the string in those situations where such movements are desired to selectively tune the string to the keyboard fret arrangement.

DESCRIPTION OF DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

FIG. 3 is an enlarged sectional view through the nut as seen along the lines 3—3 of FIG. 1 with certain structure adjacent the nut being removed;

FIG. 4 is a side elevational view showing a fragment of the nut as seen along the lines 4—4 of FIG. 3;

FIG. 5 is a top plan view of the fragment seen in FIG. 4;

FIg. 6 is a sectional view similar to FIG. 3 and illustrates a preferred form of screw element for use in supporting the guitar string;

FIG. 7 is a top plan view of the arrangement show in FIG. 6, with certain parts broken away;

FIG. 10 is an enlarged sectional view as taken along the line 10—10 of FIG. 8; and FIG. 11 is a side view of a fragment of the device seen in FIG. 10 as illustrated along the lines 11—11 therein.

DETAILED DESCRIPTION OF INVENTION

Figure 2:
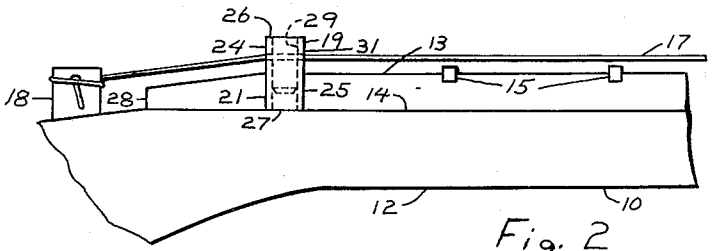
FIG. 2 is a side elevational view of the fragment seen in FIG. 1.
Figure 1:
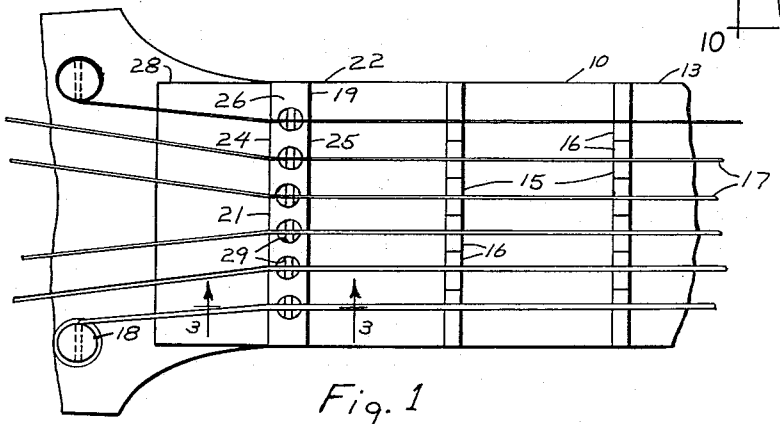
FIG. 1 is a top plan view showing a fragment at the nut end of the keyboard of a guitar and wherein the structure of the nut embodies the principles of the invention, certain parts being broken away.

Reference is now made to the drawings and wherein a guitar that is equipped for the play of a second instrument (not shown) is designated at 10. Guitar 10, embodying the principles of the invention, is seen as having a sound box or body portion 11 (FIGS. 8–9) to which a neck piece 12 is attached by means not shown. The keyboard 13 (FIG. 1–2) of the guitar is an elongated structure that is secured at the upper surface 14 of the neck piece 12 and equipped with transversely arranged frets 15. These frets are longitudinally spaced apart along the keyboard and, in the embodiment illustrated, are made up of electrically conductive segments 16 which are electrically insulated from one another. These segments of the frets underlie the respective strings 17 at the keying position associated with the fret and each fret segment is associated with a keying circuit for producing a tone on the second instrument (not shown) and which is completed through contact with the string, the strings 17 being electrically conductive and grounded in the switching circuit used in the illustration.

Each of the strings 17 is connected at one of its ends to a tail piece, not shown, but which is mounted on the body 11. At its other end, the string is connected to a post or peg 18 (FIG. 1–2) that is mounted on the neck of the guitar. These pegs 18 are rotatably adjustable by conventional means (not shown) so as to enable development of the proper tension, and thus development of the proper open string tone for each string. Between the pegs and the tail piece, the strings 17 are suspended over the keyboard 13 by means of a nut 19 (FIG. 1–2) and bridge 20 (FIGS. 8–9) that are mounted at the opposite ends 22 and 23 of the keyboard.

The nut 19 in the illustrated embodiment serves at one end 22 of the keyboard as a device for supporting the strings 17 above the keyboard. It has an elongated body portion 21 that includes vertically spaced upper and lower faces 26 and 27 and horizontally spaced opposite side walls 24 and 25. The body 21 (FIG. 1) of nut 19 is transversely arranged at the end 22 of the keyboard and is rigidly mounted between the keyboard end 22 and a reinforcing member 28 with its lower face 27 on the upper surface 14 of keyboard 13. The body portion 21 in the embodiment illustrated is made of electrically nonconductive plastic material.

The body portion 21 of the nut has a plurality of threaded bores 29 which are spaced apart in the nut structure with each bore in working alignment with the respective strings. Each bore houses a threaded screw element 30 (see FIGS. 3–50) on which the strings 17 is supported and each screw element 30 is rotatably manipulatable to adjust the vertical location of the string with respect to the keyboard.

The upper portion 31 of the nut body has a plurality of vertical slots 32 which are adapted to receive the strings supported by the nut. Each slot (see FIGS. 3–5) is associated with one of the bores and lies in a plane that is common to the vertical axis 33 of the bore and to the string supported within the bore. Each slot 32 opens upwardly through the upper face 26 of the nut body and also opens laterally through the opposite side walls 24 and 25 so that the string rests and is supported on the upper surface 34 of the screw element 30, as exemplified in FIGS. 3–5. In the embodiment illustrated, the bores also open through the lower face 27 of the nut body 21 and the lower extremity 39 of the slot is located spacedly above the lower face.

In the embodiment illustrated in FIGS. 1–5, the screw elements 30 are equipped with diametrically oriented slots 35 in their upper faces 34. These slots or recesses 35 are adapted to receive the working head of a conventional screwdriver so as to enable rotatable manipulation of the element 30 to axially adjust its location in the bore and hence the resultant position at which the string is supported in relationship to the keyboard. The location of each string in reference to the keyboard may thus be determined individually by simply rotatably manipulating the screw element to raise or lower its position in the bore.

The type recesses in the screw element 30 illustrated in FIGS. 1–5 has certain disadvantages in that the strings tend to enter the recess 35 of the screw element 30 when the slot 35 is adjusted into alignment with the string 17 supported on the screw element. FIGS. 6 and 7 illustrate a modified and preferred form of screw element 38 that may be used in the nut, and also in the bridge arrangement to be subsequently described, without encountering this difficulty. In this instance the modified screw element 38 is seen as inserted in the bore 29 of the nut body portion 21 illustrated in FIG. 1–5. Here the recess 36 in the upper surface 40 is in the form of a hexagonal socket or depression which is adapted to receive the end of the well known allen wrench. This arrangement provides a continuous uninterrupted planar portion 37 in the upper surface 48 and which completely surrounds the recess 36 so that the string is supported on the upper surface at all times.

Figure 8:
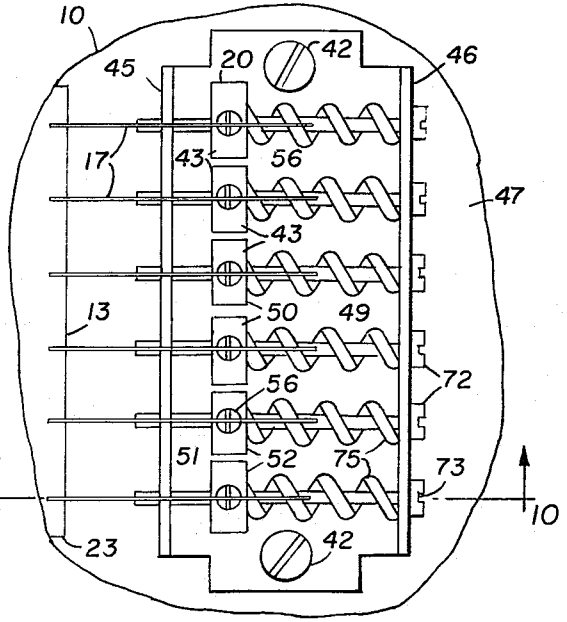
FIG. 8 is a top plan view of a fragment of the guitar shown in FIG. 1, but as seen at the bridge end of the keyboard, the view showing an assembly of the devices as mounted to enable selective tuning of the strings to the fret arrangement of the keyboard.
Figure 9:
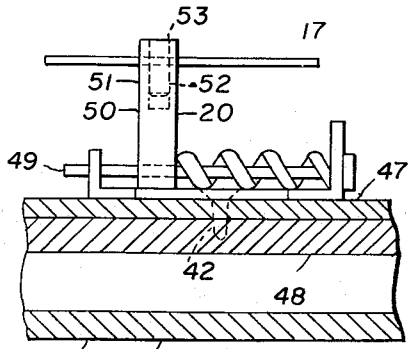
FIG. 9 is a side elevational view of the fragment seen in FIG. 8.

The bridge arrangement 20 is seen in FIGS. 8–11. In this arrangement, the bridge 20 includes a plurality of devices 43 for supporting the strings 17 at the bridge end 23 of the keyboard. Each device 43 is associated with one of the strings 17 and is slidingly supported on a U-shaped bracket 44 that is equipped with a pair of upright legs 45 and 46. These legs are spaced apart and extend transversely of and beneath the guitar strings 17. The bracket 44 is secured to the top wall 47 of the sound box 11 by screw elements indicated at 42. As seen in FIG. 9, this wall 47 has an underlying reinforcing member 48 that serves to strengthen the upper wall 47 and facilitates the mounting of the bridge and tail piece of the guitar thereon.

The legs 45 and 46 serve as mounting components for screw members 49 which are associated with the respective devices 43. Screw member 49 provides a manipulatable means for linearly moving the device in parallel with the supported guitar string 17 so as to facilitate the tuning of the string to the string keying positions on the keyboard.

Each string supporting device 43 includes a body portion 50 that has opposite side walls 51 and 52 and upper and lower faces 53 and 54. The body portion 50 is arranged upright on the bracket, as seen in FIG. 9, and with its lower face 54 in sliding contact with the flat upper surface 55 of the bracket. This surface 55 extends between the upright legs 45 and 46 and has lateral extensions for the bracket mounting screws 42 as seen in FIG. 8.

The body portion 50, like the arrangement for the nut 19, is made of nonconductive plastic in the illustration and has a threaded bore 56 which has a vertical axis 57 and opens upwardly between the side walls 51 and 52 through the upper face 53. The upper portion 58 of the body also has a vertical slot 59 that lies in a plane common to the axis 57 and to the string supported by the device. This slot 59 again opens laterally through the opposite side walls 51 and 52 and also upwardly through the upper face 53 so as to accommodate reception of the string 17 in the supported position on the upper surface 60 of the threaded screw element 61. This element 61 threadingly engages the body portion 51 within the bore 56 and can be rotated with respect to the body member about the axis 57 to axially adjust its location in the bore 56, and hence the elevation of the string with respect to the keyboard.

The elements 61 as seen in FIGS. 8–11 have diametrically extending slots or recesses 64 in their upper surfaces 66 as in the case of the threaded screw elements 30 seen in FIGS. 1–5. These slots 64 are adapted to receive the working end of a screwdriver so as to facilitate the manipulation of the screw element within the bore to raise and lower the supported position for the string. If desired, a screw element like or similar to that seen in FIGS. 6 and 7 may also be employed so as to provide an arrangement where there is a continuous uninterrupted surface surrounding the recess for supporting the string in all positions of rotation.

The lower extremity 62 of the body slot 59 and the lower extremity 63 of the body bore 56 both terminate spacedly above the lower body face 54 in the illustration. This facilitates the provision of a horizontally extending threaded bore 67 in the lower portion 65 of the body portion 50. This bore 67 opens at its opposite ends through the opposite side walls 51 and 52 and is axially aligned with the apertures 68 and 69 in legs 45 and 46 for screw member 49. The screw member 49 for linearly moving the device extends through the bore 67 and is in threaded engagement with the body portion therein. On the other hand, the opposite ends 70 and 71 of the member 49 are journaled in the legs 45 and 46 for free rotation in the apertures. At its rear end 71, member 49 is equipped with a head 72 that has a slot 73 for reception of the working end of a screwdriver so as to facilitate rotation of this member. The member 49, being free to rotate in apertures 68 and 69, is also axially slidable in the legs, and accordingly, a coiled compression spring 75 surrounds the member 49 between leg 46 and side wall 52 so as to bias the device toward the nut end of the keyboard and thus maintain the opposite ends of the screw member 49 in the leg apertures 68 and 69.

In tuning the strings (see FIG. 10) to the keyboard, member 49 is rotatably manipulated to move the device in the direction indicated by the double arrow 76. On the other hand, to vertically position the string in relation to the keyboard at the bridge end, element 61 is simply rotated to raise or lower the supporting surface for the string. The devices illustrated for supporting the strings are simple to use and inexpensive to manufacture as will be apparent to those skilled in the art.

While only certain perferred embodiments of this invention have been shown and described by way of illustration, many modifications will occur to those skilled in the art and it is, therefore, desired that it be understood that it is intended herein to cover all such modifications as fall within the true spirit and scope of this invention.

What is claimed as new and what it is desired to secure by Letters Patent of the United States is:

1. A guitar comprising an elongated horizontally arranged keyboard, a guitar string suspended over the keyboard, and a device mounted at one end of the keyboard for thereat supporting said guitar string above the keyboard, said device comprising a body portion having vertically spaced apart upper and lower faces, horizontally spaced apart opposite side walls located between said faces, an axially vertically arranged threaded bore located between said side walls and opening upwardly through the upper face of the body portion, and a vertical slot which lies in a plane common to the axis of said bore and which opens laterally of the body portion through said side walls and upwardly through said upper face, and a threaded screw element which threadedly engages the body portion within said bore and has an upper surface that is located below said upper face; said guitar string being received in said slot and supported on said upper surface, and said screw element being axially adjustable in the bore by the rotatable manipulation thereof with respect to the body portion.

2. A guitar in accord with claim 1 where said device is located at the nut end of said keyboard.

3. A guitar in accord with claim 2 where said upper surface of the screw element has a recess adapted to receive a tool for the rotatable manipulation thereof.

4. A guitar according to claim 3 where said recess is centrally located in said upper surface and is surrounded by a continuous planar portion of the upper surface.

5. a guitar in accord with claim 1 where said device is located at the bridge end of said keyboard.

6. A guitar in accord with claim 5 where said upper surface of the screw element has a recess adapted to receive a tool for the rotatable manipulation thereof.

7. A guitar according to claim 6 where said recess is centrally located in said upper surface and is surrounded by a continuous planar portion of the upper surface.

8. A guitar in accord with claim 5 where said guitar comprises means manipulatable to linearly move the device in parallel with said guitar string.

9. A guitar in accord with claim 8 where said slot has a lower extremity located spacedly above said lower face, where said guitar has a U-shaped bracket which is mounted at the bridge end of said keyboard and which has a pair of upright legs that are spaced apart along and located beneath said guitar string, where said body portion is slidingly supported on said bracket between said legs and has an axially horizontally extending threaded bore which is located between the lower extremity of the slot and the lower face of the body portion, and where the horizontally extending bore opens through the opposite side walls of said body portion, and where said manipulatable means comprises an elongated horizontally arranged member having opposite ends which are rotatably supported in the respective legs, said elongated horizontally arranged member extending through said horizontally extending bore and therein being in threaded engagement with said body portion, and said elongated horizontally arranged member having a head at one of said opposite ends and which is adapted to receive a tool for the rotatable manipulation of the horizontally arranged member to thereby horizontally adjust the location of said body portion between said legs.

10. A guitar according to claim 9 where said guitar has means biasing the body portion toward the nut end of said keyboard.

* * * * *